US006053588A

United States Patent [19]

Biggel et al.

[11] Patent Number: 6,053,588

[45] **Date of Patent: *Apr. 25, 2000**

[54] WORKSTATION

[75] Inventors: Franz Biggel, Wangen; Burkhard Schmitz, Ulm, both of Germany

[73] Assignee: Herman Miller, Inc., Zeeland, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 08/809,193

[22] PCT Filed: Jul. 22, 1995

[86] PCT No.: PCT/DE95/00968

§ 371 Date: Aug. 25, 1997

§ 102(e) Date: Aug. 25, 1997

[87] PCT Pub. No.: WO96/03901

PCT Pub. Date: Feb. 15, 1996

[30] Foreign Application Priority Data

Jul. 29, 1994 [DE] Germany ..... 44 26 921
Apr. 10, 1995 [DE] Germany ..... 195 12 712

[51] Int. Cl.[7] ..... A47B 46/00

[52] U.S. Cl. ..... 312/249.8; 312/258; 312/249.11; 312/313

[58] Field of Search ..... 312/263, 258, 312/249.8, 249.11, 310, 311, 313, 315, 321.5, 326, 329, 200, 223.3, 196, 249.12; 52/36.1, 36.4, 36.5, 64, 71, 70; 108/14, 34, 40, 33, 77, 65, 92, 38, 102, 41, 137

[56] References Cited

U.S. PATENT DOCUMENTS

| | | | |
|---|---|---|---|
| 258,604 | 5/1882 | Richardson | 312/200 |
| 786,670 | 4/1905 | Parker | 312/326 X |
| 1,027,816 | 5/1912 | Cassity | 312/200 |
| 1,128,031 | 2/1915 | Needleman | 312/258 X |
| 1,133,866 | 3/1915 | Leighty | 312/289 X |
| 1,281,923 | 10/1918 | Fales | 312/334.28 X |
| 1,348,073 | 7/1920 | Almy | 312/200 |
| 1,943,282 | 1/1934 | Bellavia | 312/222 |
| 3,087,767 | 4/1963 | Schell | 312/290 X |
| 3,588,209 | 6/1971 | Nathan . | |
| 4,417,774 | 11/1983 | Bevan et al. . | |
| 4,478,467 | 10/1984 | Tyndall | 312/249.9 |
| 4,637,177 | 1/1987 | Long | 312/258 X |
| 4,847,764 | 7/1989 | Halvorson . | |
| 5,036,472 | 7/1991 | Buckley et al. . | |
| 5,072,999 | 12/1991 | Trotta et al. . | |
| 5,429,432 | 7/1995 | Johnson | 312/313 X |
| 5,533,799 | 7/1996 | Nickolaus, Jr. | 312/249.12 |
| 5,536,080 | 7/1996 | Madimenos et al. | 312/317.1 |
| 5,558,418 | 9/1996 | Lambright et al. | 312/196 X |
| 5,803,562 | 9/1998 | Jacobs et al. | 312/315 X |

FOREIGN PATENT DOCUMENTS

| | | |
|---|---|---|
| 446064 | 1/1948 | Canada . |
| 91 16 058 | 12/1991 | Germany . |
| 94 04 456 | 3/1994 | Germany . |

*Primary Examiner*—Janet M. Wilkens
*Attorney, Agent, or Firm*—Brinks Hofer Gilson & Lione

[57] ABSTRACT

A workplace is suggested that has work surfaces and especially desk surfaces in a body which can be opened up. To attain a spacious interior, two opposing side walls (3, 4) are connected via hinges (15, 16) to a transverse wall (5) to allow the body to be unfolded as a workplace with a large area.

12 Claims, 8 Drawing Sheets

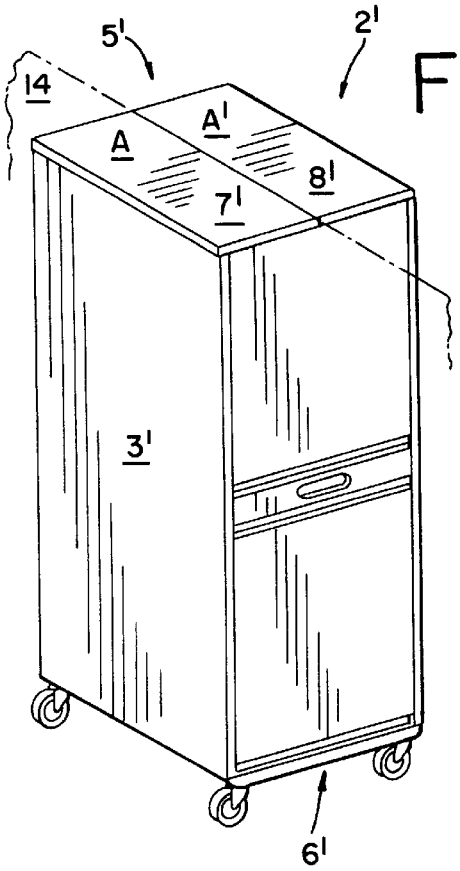
FIG. 5a
FIG. 6a
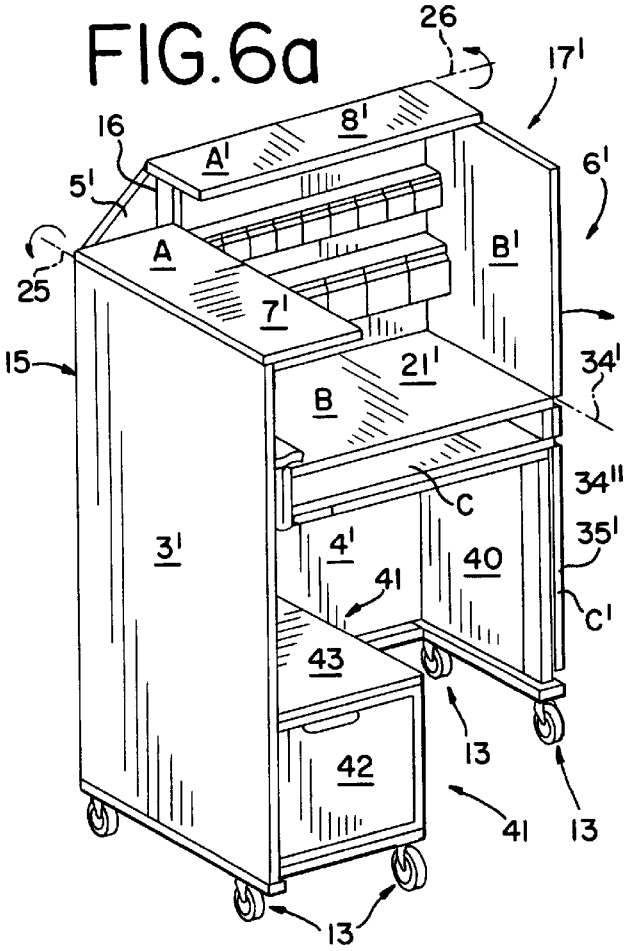
FIG. 5b
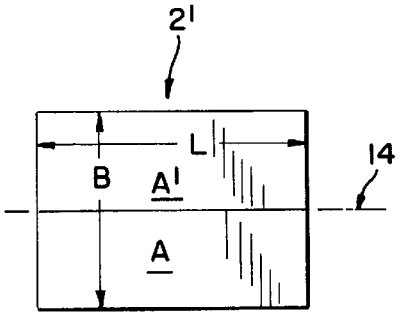
FIG. 6b
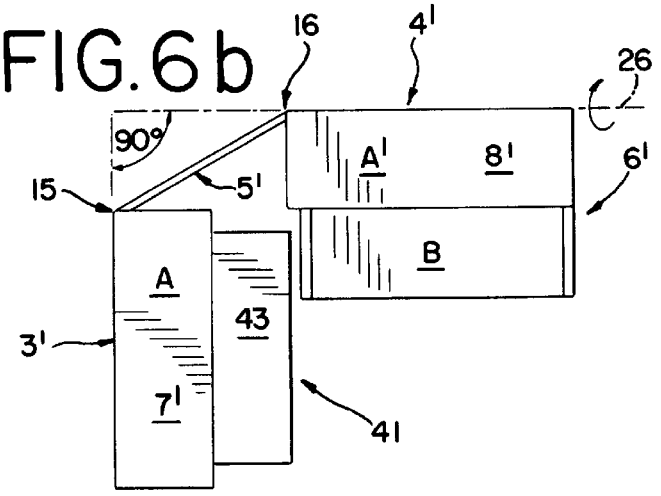

WORKSTATION

BACKGROUND OF THE INVENTION

The present invention refers to workplaces in general, and more specifically, to a collapsible workstation.

In general, a "workplace" is any spatially delimited site in a business or private residence at which a person works. The setup of workplaces particularly influences the stress and the work output of those working there. For this reason, the best possible workplace design is sought. In general, a difference is drawn between industrial and office workplaces. Such workplaces are designed differently according to their use.

An office workplace is generally identified as a desk in the broadest sense. Modern desks offer numerous design possibilities of desk surface arrangements. In particular at computer workplaces, work is carried out on surfaces at different heights to achieve an ergonomic operation of the individual devices and to allow the persons at this workplace to work in an ergonomic manner.

The work at workplaces in offices or production facilities is generally organized by assigning each person an individual workplace. This allows workers to individually complete their work assignments and best use their workplace.

The disadvantage of conventional workplaces is generally that they require a great amount of space because of the variety of required work surfaces and their fixed and inflexible spatial arrangement. It is furthermore disadvantageous that the workplaces always have to be cleaned or cleared by the people working at them, especially in offices with several workplaces. This takes up a significant amount of work time. When a worker is absent, the workplace generally must be cleared, i.e., individual jobs must be temporarily set aside. From this vantage point, the so-called "secretarials" familiar from years back seem to be quite an advantage with work surfaces on several levels; in particular, they could be closed with a roll top or something similar without having to be cleaned up at the end of the day. This had the advantage of eliminating unnecessary clean-up so that, when starting work again, workers could begin immediately at the point where they left off.

An office container has e.g. been made known in DE 41 06 141 that is particularly useful as a computer workplace. A storage surface is provided for the devices. This well-known office container also has other storage and writing surfaces.

This office container is also built like a cabinet and, as a whole, is not suited for use as a conventional desk.

The invention is based on the task of creating a workplace that can be used very flexibly in an office or production facility and as an individual workplace adapted to the user.

The invention is based on the concept that a flexible workplace can only be created when its spatial arrangement is flexible, i.e., it can be used in most any location, and it can be individualized. This yields completely new areas and optimal conditions for use.

SUMMARY OF THE INVENTION

The workplace according to the invention is constructed like a container workplace that, in its original position, is a closed body (container box), preferably with a rectangular design, which can be transported. In its most compact form such a body has the shape of a cabinet, box, etc. and is opened when used and unfolds into a workplace system. The individual workplace elements are swung e.g. on two vertical swiveling axes of a transverse side wall so that the original box yields an open workplace preferably arranged at an angle.

This workplace contains numerous work surfaces, drawers, shelves, etc. that are attached to the individual side walls and rendered accessible by opening up the workplace system. When closed, the individual work surfaces are adapted to each other so that they work together without colliding and are arranged in different planes. When unfolded, a work area results with writing and storage surfaces, which makes lighting devices, storage areas, pinning surfaces, etc. accessible on an area of four square meters. Even a correspondingly arranged chair can be integrated into the closed workplace.

Such a workplace is preferably manufactured with base dimensions of 120×80 cm to correspond to the common transport dimensions of a europallet. This allows the workplace to be loaded and transported using a europallet. On site, the workplace is transported on castors so that it can be moved by individuals.

The workplace also has the advantage that it has two "faces". On the one hand, the "external face" belongs to the business and represents the company image with a unified and formal design. On the other hand, the inside represents the character of the user and allows highly individual furnishing without conflicting with the company image.

The workplace can be reconfigured as needed so that one can be shielded from the environment. Due to its ability to be manipulated, the workplace can be turned toward the neighboring workplace or form a group workplace for another activity.

Another advantage is that the respective workplaces do not have to be cleaned up. They can be left in any condition when the body is closed. The possibility of leaving all one's jobs as they are in the middle of work even though the body is closed makes it unnecessary to reorganize when recommencing work. This makes it much easier to get back into certain jobs, e.g., at the beginning of the week or after a vacation.

The workplace according to the invention hence allows greater flexibility in work hours as well as work structuring with less organizational effort. Traditional workplaces can be transformed into flexible workplaces that can be easily used for temporary jobs. In particular, each temporary worker's workplace is not changed, i.e., they receive their own workplace during their temp job, and the workplace can be closed up afterwards. The workplace according to the invention is therefore a complete workplace that can be closed while the user is absent and moved to another site when space is needed.

It is well-known that in many companies, the organization and administration are decentralized and performed on-site. In these instances, the workplace according to the invention can be directly and flexibly assigned to different departments on a short-term basis, i.e., an engineer can for example temporarily move his workplace from the office to manufacturing.

Another advantage of the workplace according to the invention is that it can be moved to any desired site. Such workplaces can be used wherever workplaces are needed for a specific period, e.g., fairs, conventions, functions, construction projects, etc. This is especially true for Work temporarily relocated to one's residence. A company workplace can easily be moved to a private residence, and the workplace in the home can be closed and stored in a small space at the end of the workday.

Another invention design example has an even more compact workplace construction which is e.g. only 70 cm long and 50 cm wide when closed. The basic principle described above is retained here as well.

Further details and advantages of the workplace according to the invention are in the drawings that will be further explained in subsequent design examples.

BRIEF DESCRIPTION OF THE DRAWINGS

FIG. 5*a* is another design example of a workplace;

FIG. 5*b* is a top view of the design in FIG. 5*a;*

FIG. 6*a* is an opened view of the workplace of FIG. 5*a;*

FIG. 6*b* is a top view of the opened workplace of FIG. 5*a;*

DETAILED DESCRIPTION OF THE PREFERRED EMBODIMENTS

Figure 1:
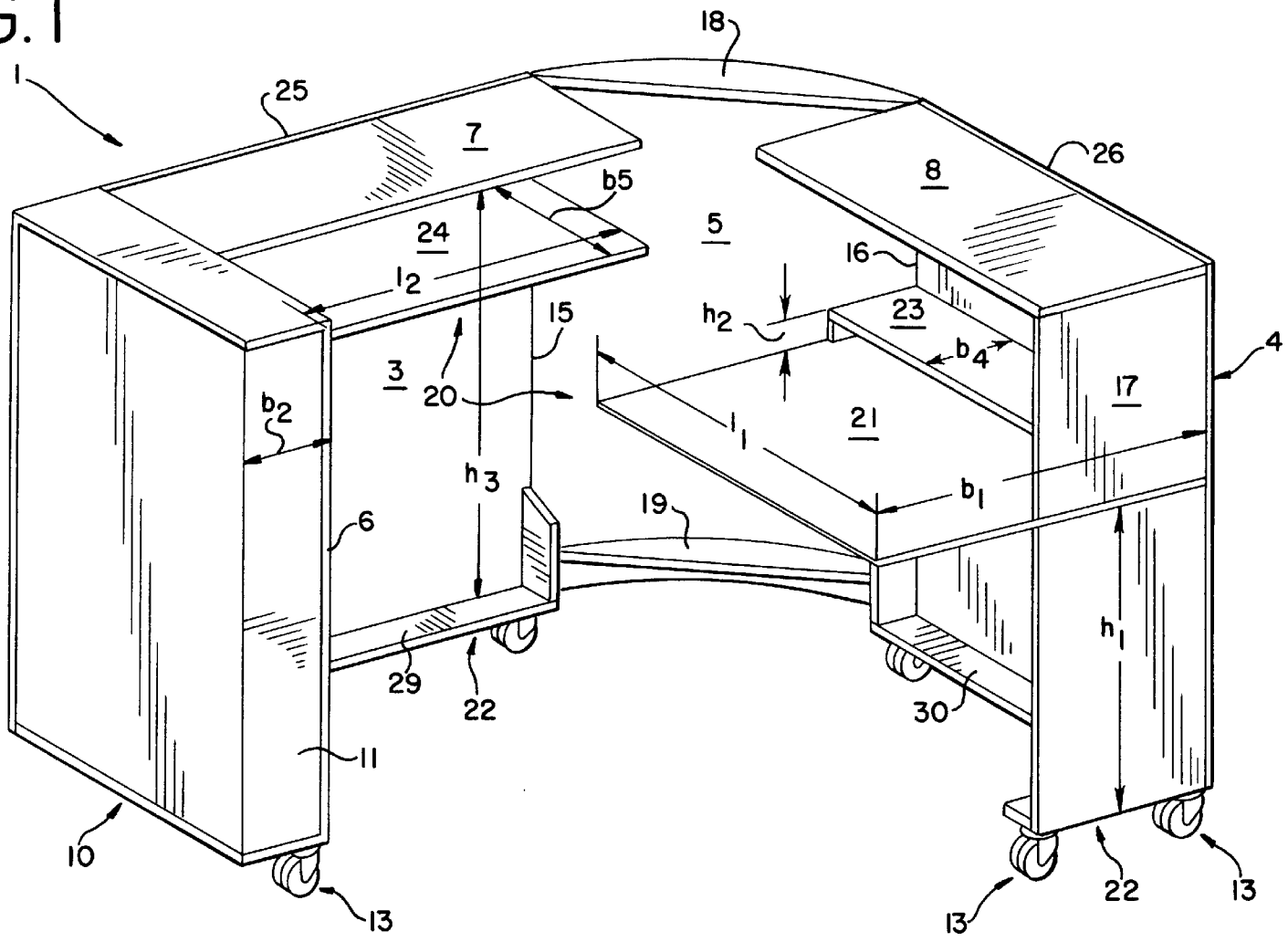
FIG. 1 is a perspective view of an opened workplace.

The representation of the invention in FIG. 1 shows an open workplace 1 that is especially useful as an office workplace. The same workplace is shown closed in FIG. 2 as a cabinet-like body 2 or container box 2.

The body 2 which can be closed or opened to form a workplace 1 consists of two longitudinal side walls 3, 4, a first transverse side wall 5 and an opposing second transverse side wall 6. The closed body has a length L=120 cm, a width B=80 cm and a height H=110 cm. The base area of L×B is suitable for placing the body on a conventional europallet for transport.

The body 2 also has a top cover consisting of two separate cover panels 7, 8 and a largely open floor area 9. The second transverse side wall 6 itself is designed as an independent cabinet body 10 from which a shelving insert 11 can be laterally withdrawn (see FIG. 3). The outer contour 12 of the first transverse side wall 5 follows a regular cylinder which gives the body a corresponding design. On the bottom of the body 2 are individual castors 13 that enable each part to be stably moved when unfolded.

Figure 2:
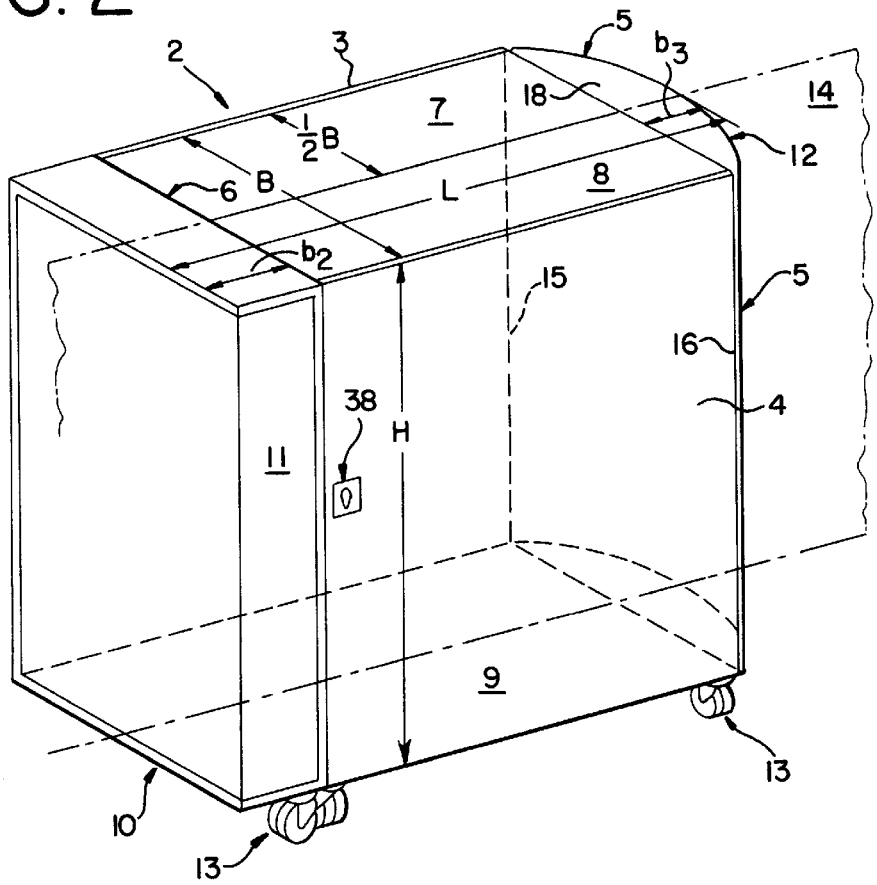
FIG. 2 is the workplace shown in FIG. 1 in closed position.

A longitudinal central plane 14 is schematically indicated in FIG. 2 that vertically divides the closed body.

To unfold the closed body shown in FIG. 2 to form a workplace, the first transverse side wall 5 has vertical hinges 15, 16 on either side, i.e., the transverse side wall 5 is connected via hinge 15 to the first longitudinal side wall 3 and via hinge 16 to the second longitudinal side wall 4. When unfolded, the body initially divides approximately along its longitudinal central plane of symmetry 14 so that the two cover plates 7, 8 separate at an angle. The longitudinal side wall 4 has a transverse wall 17 at its end opposite the first transverse side wall 5 which is approx. as wide as the top cover plate 8, i.e., the width=½ B. On the bottom end of the transverse wall 17 are two end castors 13. When the workplace is closed, the transverse wall 17 contacts the inside of transverse wall 6 and extends approx. up to the longitudinal central plane of symmetry 14. The longitudinal side walls 3 and 4 can swing over a swing angle of 0 to 270 degrees.

Corresponding to its cylindrical outer contour, the first transverse side wall 5 has top 18 and bottom 19 circle-segment end plates that stabilize the side wall 5 and serve as a lateral termination to the other walls. In particular, the top section 18 lies in the same plane as the two end covers 7, 8 when the body 2 is closed.

The inside of the opened workplace is formed by several work surfaces 20 that are adjacent to each other and/or overlap without colliding when the workplace is folded together. Accordingly a first desk surface 21 is at height $h_1$ (normal desk height) above the bottom edge 22 of the body. Width $b_1$ is almost as wide as the overall width B of the body to yield the largest possible desk work surface. Length $\mathbf{1}_1$ is almost as long as the overall length L minus width $b_2$ of the attached cabinet body 10 and width $b_3$ of the curved transverse side wall 5 or cover plate 18. In this case as well, nearly the entire length of the body is used for desk surface 21.

Desk surface 21 is assigned a small storage surface 23 with the same length $l_1$ with width $b_4 \approx ¼\ b_1$. It is slightly higher at height $h_2$ than desk surface 21 and hence forms a double storage surface in this area.

Figure 3:
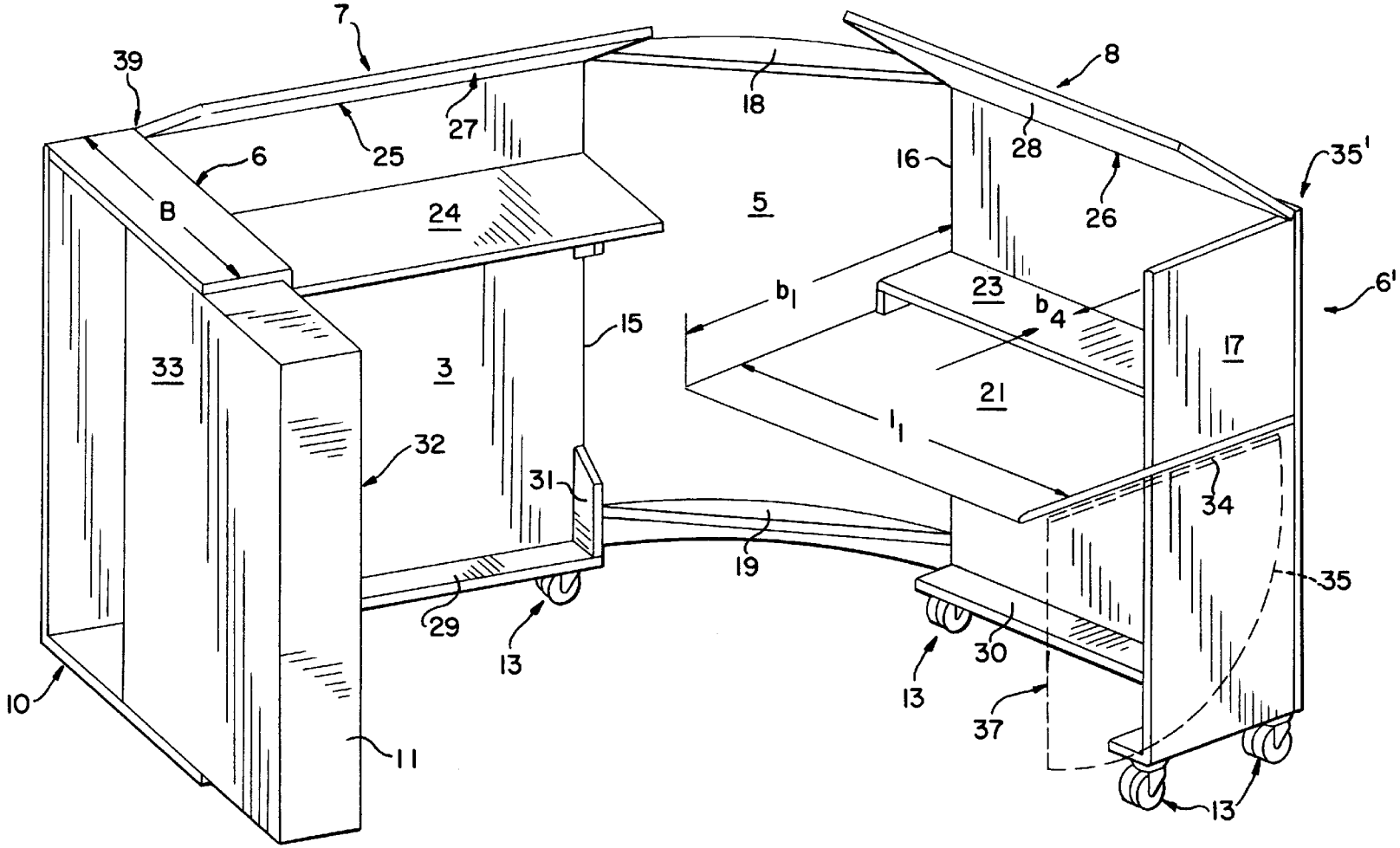
FIG. 3 is another representation of the workplace in FIG. 1.

The desk surface 21 and the other storage surface 23 are attached to the side and the associated transverse wall 17 (see also FIG. 3).

In FIG. 1, another desk surface 24 is located at the opposing side wall 3 at height $h_3$ from the bottom edge 22. Height $h_3$ is the height of a standing desk. Width $b_5$ can be equal to width $b_1$, i.e., it can also extend across the entire inner width of the body. It can also be designed smaller.

Length $\mathbf{1}_2$ of desk surface 24 can approx. correspond to length $L_1$ of desk surface 21.

The two top cover panels 7, 8 are connected via hinges 25, 26 to the associated longitudinal side wall 3, 4. The cover can be swung up vertically or assume any intermediate position as shown in FIG. 3. When covers 7 or 8 are swung up, the inside 27 of cover 7 or the inside 28 of cover 8 can be used as a visual screen from the neighboring workplaces and as a bulletin board, display, etc.

In the bottom area, the two longitudinal side walls 3, 4 each have an inwardly-extending reinforcing board 29, 30. In particular, reinforcing board 30 can be used as a foot rest when someone works on desk surface 21. A vertical support wall 31 on reinforcing board 29 serves as a stop for the bottom circular segment section 19 when the body is folded together. At the same time, the bottom reinforcement boards 29, 30 serve to hold the necessary castors 13 on both sides of the first transverse side wall 5 and at the opposing end.

The shelving insert 11 which can be pulled out is guided on a longitudinal guide (not shown) in the front cabinet body 10. Its side 32 facing the workplace has shelves, drawers, compartments, etc., and the outside 33 is designed as a continuous wall. The shelves, etc. are only accessible when the shelving insert 11 is withdrawn from the cabinet body 10.

Swinging the top panels 7, 8 up and withdrawing the shelving insert 11 allow the to create a visual shield with the pretense of utility without making other colleagues feel excluded.

The bottom of the body 2 has enough individual castors 13 to fully support moveable part.

In FIG. 3, an additional horizontal hinge 34 (drawn in a dashed line) is attached to the transverse wall 17 at the height of desk surface 21 to which a folding table 35 is attached. This folding table 35 (drawn in a dashed line) is a quarter-circle cross section; when swung up, it serves as an additional work surface, conference table or connecting surface to the neighboring workplaces.

Figure 4A:
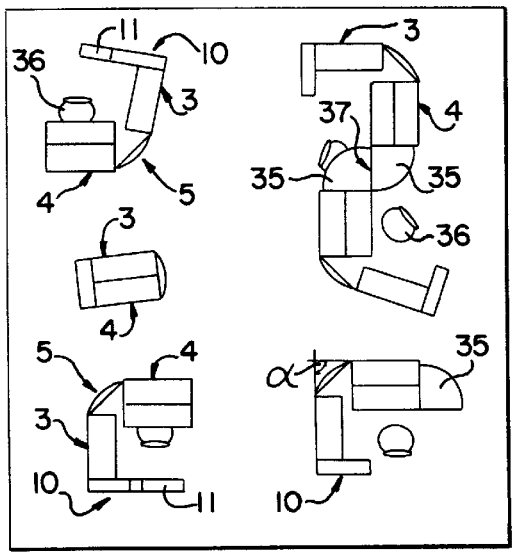
FIG. 4*a* is a different possible arrangement of the workplace.
Figure 4B:
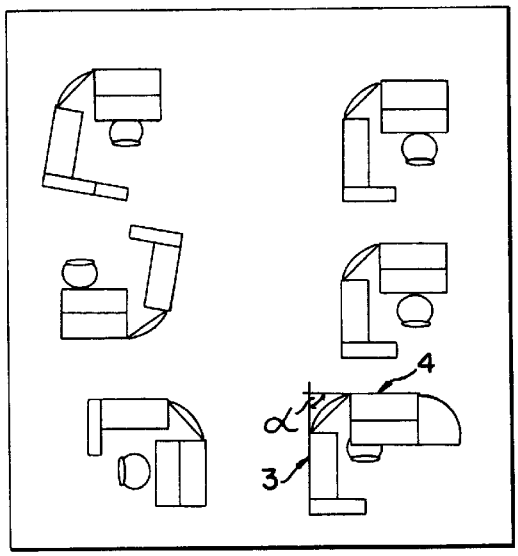
FIG. 4*b* is another possible embodiment of the workplace.

Shown in FIGS. 4*a*, 4*b* are a few design examples of the workplace 10 according to the invention. Each workplace may have an additional seat (not shown in FIGS. 1–3) that can be integrated with the closed body. This can be accomplished by installing a corresponding support construction or a chair holder within the body.

FIG. 4*a* shows six workplaces that are arranged in two adjacent rows. As an example the middle workplace on the left of FIG. 4*a* is closed (as in FIG. 2), whereas the workplaces above and below are open. The workplace is preferably opened to yield an angle $\alpha \sim 90–120°$ between the longitudinal side walls 3, 4; and the longitudinal side walls 3, 4 are connected by the diagonal transverse side wall 5.

In FIG. 4*a* on the top right, two workplaces facing the opposite direction are connected to yield joined workplaces. The folding tables 35 which can be swung up join at connecting edge 37. In FIG. 4*a* on the bottom right is a single workplace in its normal position, i.e., at a right angle. The additionally swung-up folding table 35 increases the work surface. The shelving insert 11 in the adjacent workplace is withdrawn from the cabinet body 10.

FIG. 4*b* shows an alternative arrangement of workplaces in a room. This could be the same room on another day. The workplaces are arranged individually, and each workplace k is assigned to or set up for the individual working at them. After work ends, each workplace can be easily closed and assume the shape in FIG. 2. Things do not have to be cleaned up or moved around. A schematically illustrated locking system 38 can make such a workplace inaccessible for unauthorized persons. Of course, the respective side walls and top panels 7, 8 can be fixed and locked in place and made inaccessible from the outside. The entire workplace can be locked with the locking system 38. A bottom floor lock is generally not necessary since the workplace is inaccessible from below due to its great weight. This can be accomplished in special instances, however, by putting in certain floor panels.

In another design the transverse side wall 6 with the cabinet body 10 can also be flexibly articulated via another hinge 39 to side wall 3. In like manner, side wall 17 can be articulated to side wall 4 via a vertical hinge.

Figure 8A:
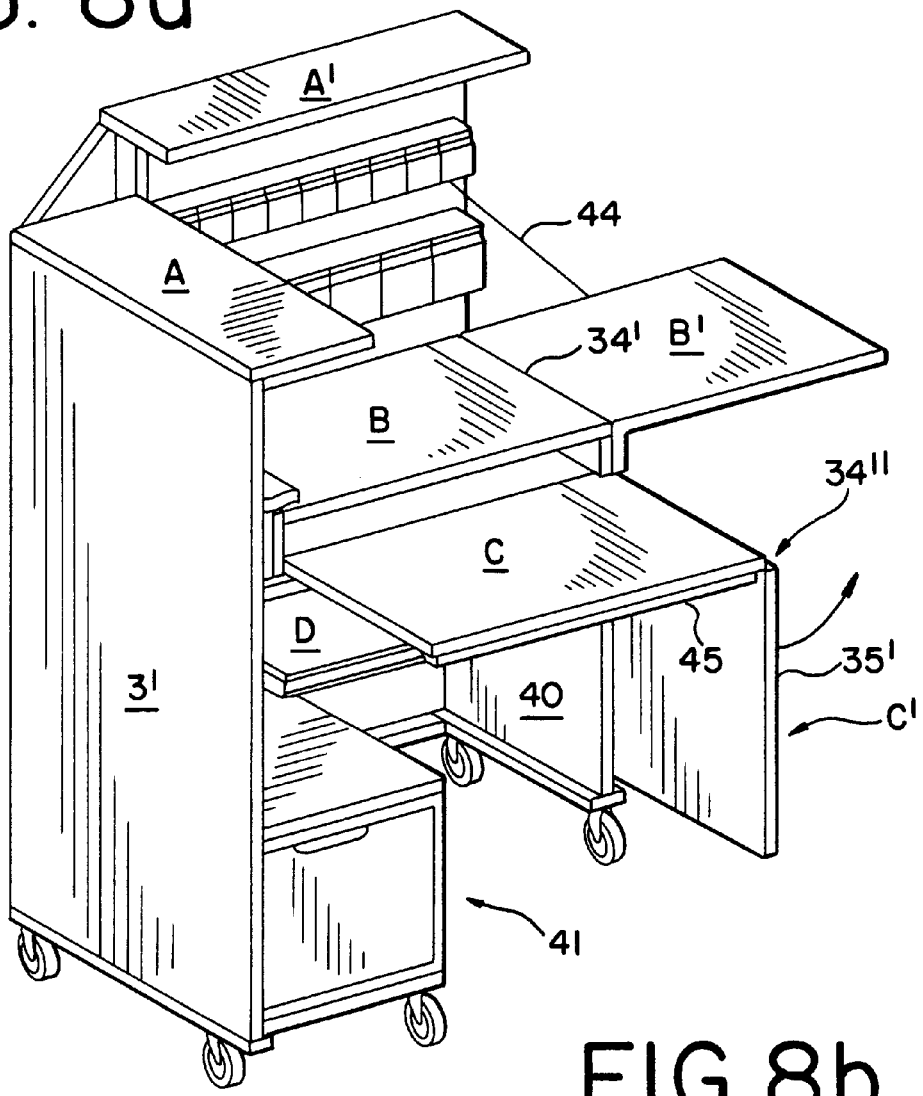
FIG. 8*a* is an even further expanded view of the workplace of FIG. 5*a;*
Figure 8B:
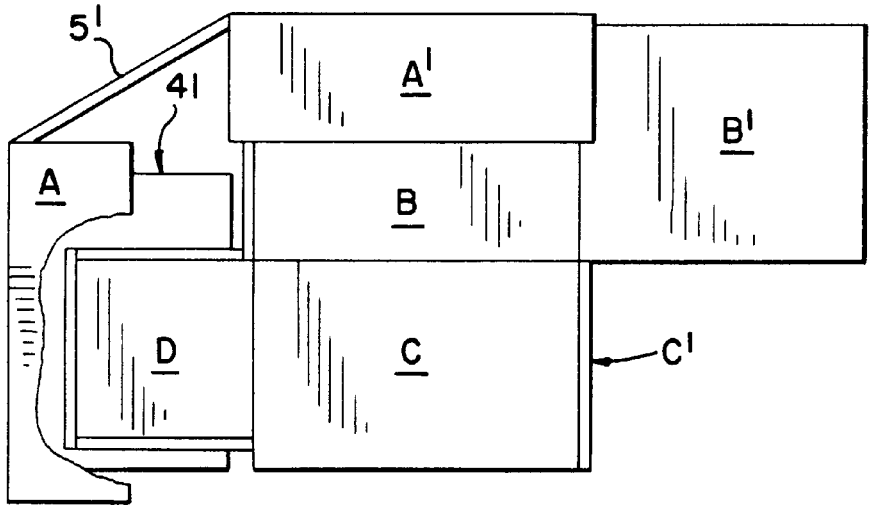
FIG. 8*b* is a top view of FIG. 8*a;*
Figure 9A:
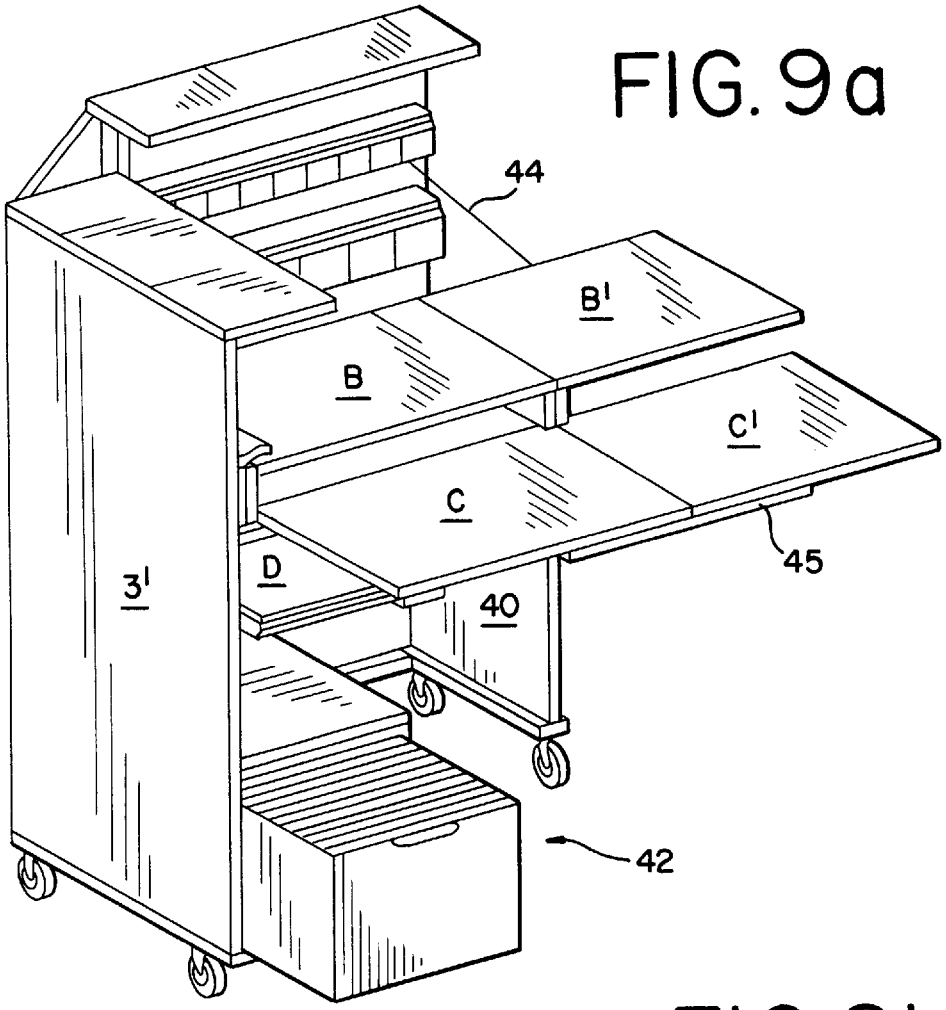
FIG. 9*a* is an even still further expanded view of the workplace of FIG. 5*a;*
Figure 9B:
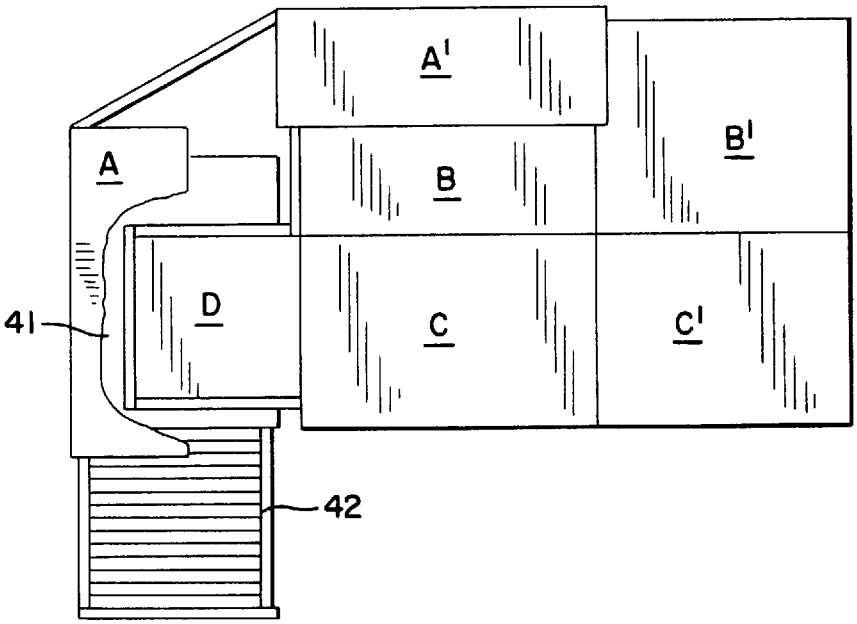
FIG. 9*b* is a top view of FIG. 9*a;*.
Figure 10:
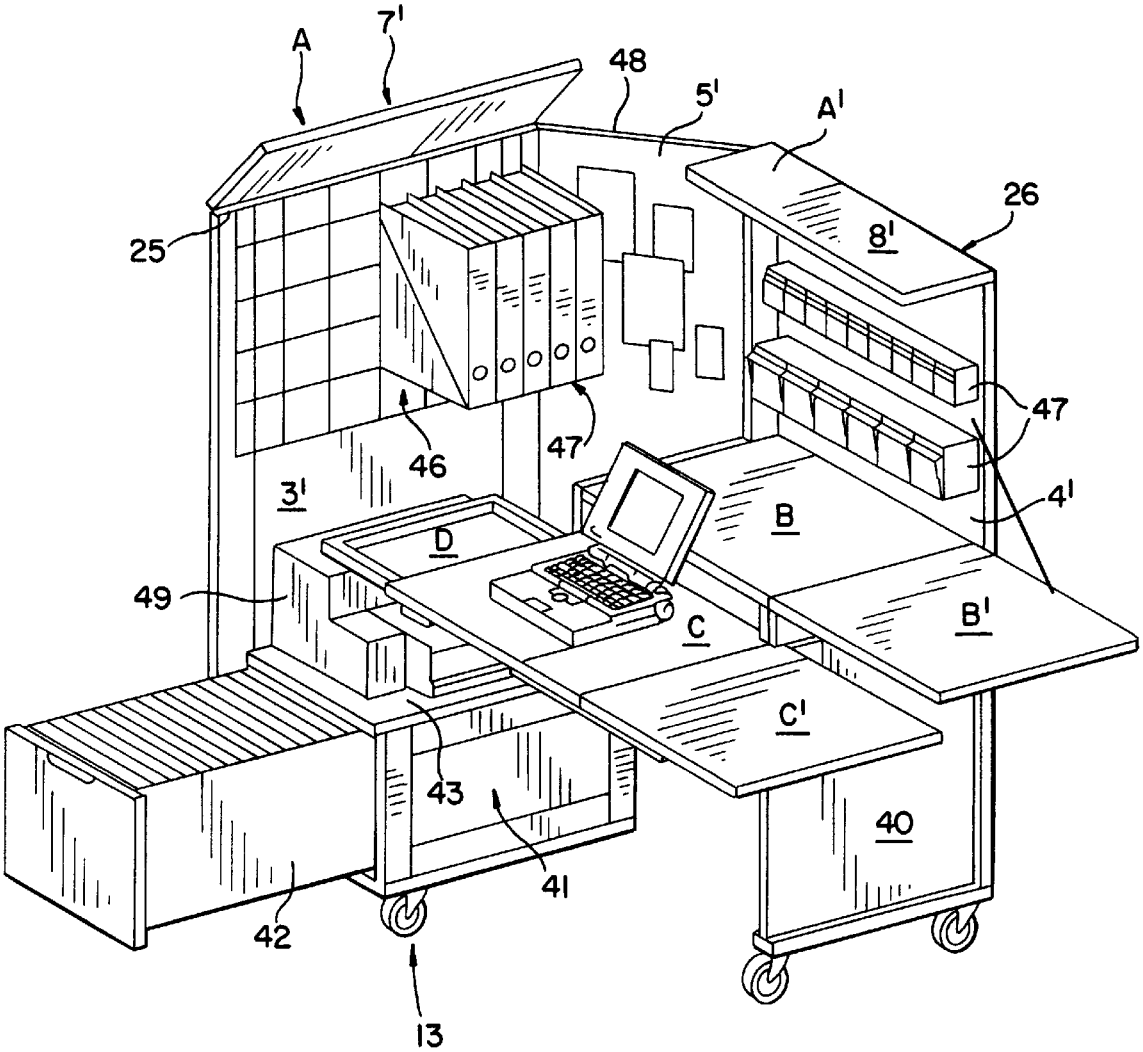
FIG. 10 is a final possible embodiment of the workplace of FIG. 5*a.*

In another design example of the invention in FIGS. 5*a*, 5*b*–9*a*, 9*b* and in FIG. 10, another variation of the invention is represented with a more compact arrangement. The respective FIGS. 5*a*–9*a* portray perspective representations of the same opened body in different working positions. FIGS. 5*b*–9*b* show the associated top views. FIG. 10 shows the basic working arrangement of the workplace with withdrawn work surfaces.

In FIGS. 5–10, the same parts are given the same reference numbers as far as they have already been noted in FIGS. 1–4. In addition, however, the different work surfaces and top panels are identified with upper-case letters A, A'–C, C' for greater clarity.

FIG. 5*a* shows the second design example with a closed or folded body 2'. FIG. 5*b* shows the corresponding top view. The length is L≈70 cm and the width B≈50 cm. The height corresponds to that in the design example in FIGS. 1–4.

The body 2' in FIGS. 5*a*, 5*b* is initially opened up to a 90° angle according to the perspective representation in FIG. 6*a* and top view in FIG. 6*b*, i.e., extending the side walls 3', 4' yields a corresponding right angle, and the walls are articulated to each other via the first transverse side wall 5'.

The top panels 7', 8' are identified as the first storage surfaces A, A'. The two equally-sized top panels can be swung up via associated horizontal hinges 25, 26 as is symbolically represented by top panel A in FIG. 10.

The side wall 4' has another work surface 21' or B in an intermediate plane corresponding to table panel 21 in FIG. 1 that is articulated via a horizontal hinge or joint 34' to vertical side panel 17' or B'. At only a slight distance below work surface B there is another, withdrawable work surface C that is articulated to another side wall 35' via a lateral horizontal hinge 34". In FIG. 6*a* the side walls 17', B' and 35', C' are arranged vertically and hence form the second transverse side wall 6' to seal off the side of the body when closed.

Parallel to side wall part 35' in FIG. 6*a* is a fixed bottom wall part 40 as a side support with individual castors 13 underneath that is fixed to side wall 4'. Furthermore, FIGS. 6*a*, 6*b* show a box 41 connected to the side wall 3' with a drawer 42 that can be pulled out. The box 41 has a top storage surface 43. It extends across nearly the entire length of side wall 3'. Another support castor 13 can be added on the bottom inner front side.

Figure 7A:
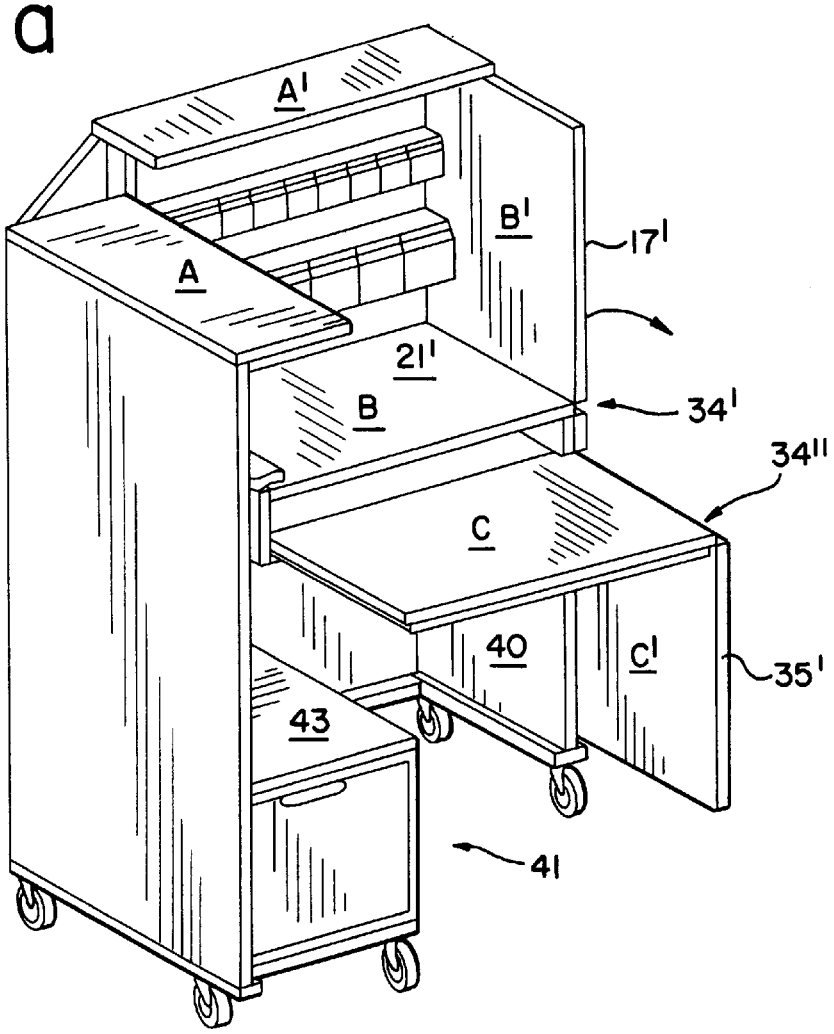
FIG. 7*a* is a still further expanded view of the workplace of FIG. 5*a;*
Figure 7B:
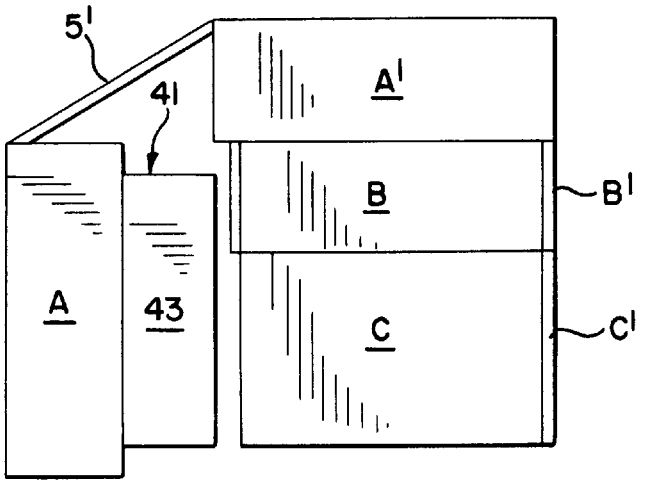
FIG. 7*b* is a top view of FIG. 7*a;*

The drawings in FIGS. 7*a*, 7*b* basically differ from those in FIGS. 6*a*, 6*b* in that table panel C below table panel B is pulled out, and side wall 35', C' is also pulled forward attached to articulation 34". Corresponding telescoping guide rails (not shown) hold table surface C in position. Side part 35' hence moves forward in contrast to stationary part 40.

In the drawing of the workplace design in FIGS. 8*a*, 8*b*, the side wall 17' is swung on its horizontal hinge 34' into a horizontal position to form table leaf B'. In addition, there is a sliding panel D under table panel C which is pulled out on corresponding telescoping guide rails on the sides so that table panel D rests above box 41. The desk panel B and C are located approx. at normal desk height, and desk panel C is slightly below desk panel B.

To supplement the drawings in FIGS. 8*a*, 8*b*, the drawings in FIGS. 9*a*, 9*b* show desk panel C' swung up on the side, and drawer 42 of box 41 is pulled out. Table panel B' in FIGS. 8*a*, 9*a* can be held horizontally by a cable 44. The swung-up table leaf C is held by a telescoping guide rail 45 that can be pulled out from its horizontal position on the sides under desk panel C.

The drawing in FIG. 10 shows a practical example of the present invention. The parts are marked with the corresponding references. A shelving system 46 for binders 47 can be located on longitudinal side wall 3'. The longitudinal side wall 4' can have a drawer system or small pails container 47 above desk panel B. The transverse side wall 5' can be designed as a bulletin board 48. Pull-out surface D is stored under desk surface C and can be designed as a drawer holder. The box 41 can have a printer 49 on its top 43.

The invention is not limited to the described and illustrated design examples. It comprises all additional engineered designs and improvements within the framework of the patent claims.

We claim:

1. A collapsible workstation that collapses into a rectangular box and opens to a usable workstation, comprising:

a first transverse side wall;

a first longitudinal side wall pivotally attached to the first transverse side wall with a vertical hinge;

a second longitudinal side wall pivotally attached to the first transverse side wall with a vertical hinge;

a second transverse side wall attached to the second longitudinal side wall, the second transverse side wall having a wall section pivotable about a horizontal transverse axis, whereby in horizontal position forms a work surface, wherein the wall section is hidden from view when the workstation is collapsed;

a first work surface attached to the first longitudinal side wall and extending beyond the mid-point between the first and second longitudinal side walls when the workstation is closed; and a second work surface attached to the second longitudinal side wall and extending beyond the mid-point between the first and second longitudinal side walls when the workstation is closed.

2. The workstation of claim 1 wherein the first and second longitudinal side walls each include a castor to facilitate opening and closing as well as transporting the workstation.

3. The workstation of claim 1 wherein the first and second work surfaces lie in different planes and wherein the work surfaces overlap when the workstation is closed.

4. The workstation according to claim 1 wherein the first and second work surfaces each extend across the entire length of the first and second longitudinal side walls, respectively.

5. The workstation of claim 1 further comprising a first top cover attached to the first longitudinal side wall and a second top cover attached to the second longitudinal side wall, wherein the first and second top cover meet when the workstation is closed.

6. The workstation of claim 5 wherein the first and second top covers are attached to the respective first and second longitudinal side walls with a hinge.

7. The workstation of claim 1 wherein the first transverse side wall has a curved cross-section.

8. The workstation of claim 1 wherein a third transverse side wall is attached to the first longitudinal side wall and is configured as a cabinet body with a withdrawable shelving insert.

9. The workstation of claim 1 wherein the first longitudinal side wall is pivotable over a pivot angle of from 0–270°.

10. The workstation of claim 1 wherein the second longitudinal side wall is pivotable over a pivot angle of from 0–270°.

11. A collapsible workstation that collapses into a rectangular box and opens to a usable workstation, comprising:

a first transverse side wall;

a first longitudinal side wall pivotally attached to the first transverse side wall with a vertical hinge, wherein the first longitudinal side wall is pivotable over a pivot angle of from 0–270°;

a second longitudinal side wall pivotally attached to the first transverse side wall with a vertical hinge, wherein the second longitudinal side wall is pivotable over a pivot angle of from 0–270°;

a second transverse side wall attached to the second longitudinal side wall;

a first work surface attached to the first longitudinal side wall and extending beyond the mid-point between the first and second longitudinal side walls when the workstation is closed;

a second work surface attached to the second longitudinal side wall and extending beyond the mid-point between the first and second longitudinal side walls when the workstation is closed; and wherein the first and second longitudinal side walls each include a castor to facilitate opening and closing as well as transporting the workstation.

12. The workstation of claim 11 further comprising a box with drawers attached to one of the side walls.

* * * * *